US011110365B2

(12) United States Patent
Ertur

(10) Patent No.: US 11,110,365 B2
(45) Date of Patent: Sep. 7, 2021

(54) PORTABLE AND MODULAR WATER AMUSEMENT SYSTEM WITH EASY AND INTUITIVE SETUP AND STORAGE

(71) Applicant: Avaden LLC, Boca Raton, FL (US)

(72) Inventor: David Ertur, Boca Raton, FL (US)

(73) Assignee: Avaden, LLC., Boca Raton, FL (US)

( * ) Notice: Subject to any disclaimer, the term of this patent is extended or adjusted under 35 U.S.C. 154(b) by 0 days.

(21) Appl. No.: 16/963,169

(22) PCT Filed: Mar. 8, 2019

(86) PCT No.: PCT/US2019/021364
§ 371 (c)(1),
(2) Date: Jul. 17, 2020

(87) PCT Pub. No.: WO2019/173722
PCT Pub. Date: Sep. 12, 2019

(65) Prior Publication Data

US 2021/0121789 A1 Apr. 29, 2021

Related U.S. Application Data

(60) Provisional application No. 62/640,838, filed on Mar. 8, 2018.

(51) Int. Cl.

| | |
|---|---|
| ***A63H 23/16*** | (2006.01) |
| ***A63G 31/00*** | (2006.01) |
| ***A63H 29/14*** | (2006.01) |

(52) U.S. Cl.
CPC ..... *A63H 23/16* (2013.01); *A63G 31/007* (2013.01); *A63H 29/14* (2013.01); *A63G 2200/00* (2013.01)

(58) Field of Classification Search
CPC ..... A63G 31/00; A63G 31/007; A63H 23/00; A63H 23/14; A63H 23/16
(Continued)

(56) References Cited

U.S. PATENT DOCUMENTS 4,243,220 A * 1/1981 Shelley ..... A63F 9/0079 273/458
5,022,588 A 6/1991 Haase
(Continued)

OTHER PUBLICATIONS

International Search Report issued for International Applicaton No. PCT/US1921364 dated May 24, 2019.
(Continued)

*Primary Examiner* — Kien T Nguyen
(74) *Attorney, Agent, or Firm* — Fleit Intellectual Property Law; Jose Gutman

(57) ABSTRACT

A water play structure (100) includes a frame base (102), a telescoping hollow frame column (112) supported in a vertical orientation and stabilized by the frame base, and a plurality of frame arms (110, 118). Each frame arm extends horizontally radially outward from, and mounted to, one of the frame base or the telescoping hollow frame column. An outward distal end of a first frame arm includes a first interface structure, and each water play station (108, 202), selected from a plurality of different water play stations, includes a second interface structure. The first interface structure and the second interface structure are standardized mutually compatible interface structures which allow different water play stations to be coupled to, and used with, each frame arm in a modular implementation.

11 Claims, 11 Drawing Sheets

(58) Field of Classification Search
USPC ..... 472/117, 128; 446/153
See application file for complete search history.

(56) References Cited

U.S. PATENT DOCUMENTS

| | | | | |
|---|---|---|---|---|
| 5,934,563 | A | 8/1999 | Gapco | |
| 8,037,906 | B1 * | 10/2011 | Grillo | A63G 31/007 141/10 |
| 2004/0014529 | A1 | 1/2004 | Briggs et al. | |
| 2012/0028724 | A1 | 2/2012 | Ensing | |
| 2018/0133606 | A1 * | 5/2018 | Briggs | A63G 31/007 |

OTHER PUBLICATIONS

Written Opinion of the International Searching Authority issued for International Applicaton No. PCT/US1921364 dated May 24, 2019.

* cited by examiner

PORTABLE AND MODULAR WATER AMUSEMENT SYSTEM WITH EASY AND INTUITIVE SETUP AND STORAGE

CROSS-REFERENCE TO RELATED APPLICATION

This application is based upon and claims priority to U.S. Patent Application Ser. No. 62/640,838 filed on Mar. 9, 2018, the disclosure of which is hereby incorporated by reference in its entirety.

BACKGROUND

The present disclosure generally relates to water amusement and play systems and water toys, and more particularly to a portable, structural water amusement system used by children of all ages for interactive and educational play, primarily in, but not limited to, residential environments such as backyards where easy set up and storage of such systems are important aspects of such systems.

Families have been enjoying water-based entertainment for many years by going to water parks, but the park experience is costly and can be very care intensive for parents, especially for those with younger children. These families are opting to go to smaller, local public parks with splash pad structures that provide a variety of less intensive water play activities for minimal to no entry fees. However, due to lack of nearby parks or the inconvenience of taking the family out to a park, families are looking to bring the splash pad experience home, without the expense or permanence of building in a splash pad structure.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

As required, detailed embodiments are disclosed herein; however, it is to be understood that the disclosed embodiments are merely examples and that the devices, structures and methods described herein can be embodied in various forms. Therefore, specific structural and functional details disclosed herein are not to be interpreted as limiting, but merely as a basis for the claims and as a representative basis for teaching one of ordinary skill in the art to variously employ the disclosed subject matter in virtually any appropriately detailed structure and function. Further, the terms and phrases used herein are not intended to be limiting, but rather, to provide an understandable description. Additionally, unless otherwise specifically expressed or clearly understood from the context of use, a term as used herein describes the singular or the plural of that term.

Referring to FIGS. 1A to 6D, an example of a water amusement system (also referred to as a "water play structure") (100) with multiple stations for water play accessories (also referred to as "play stations" or "water play stations") is shown, according to various embodiments of the present disclosure. The water play structure (100) comprises a rigid, portable, fixed-frame configuration water play structure with multiple stations for play accessories that are easily attachable and detachable without tools for quick set up and storage, but that still do not disconnect under water pressure. According to various embodiments, the structure (100)

connects directly to a backyard hose, as an example, or to another pressurized water supply, and internal plumbing in the structure (100) delivers water to each of the play stations.

To enhance the setup experience, according to various embodiments, water play accessories utilize an indicator artifact, affixed to, stamped on, or otherwise integrated with, each play station. An indicator artifact on a play accessory can be, for example, a symbolically coded, point based water flow usage rate designation for that particular play accessory, which allows a user intuitive visual and/or tactile determination of a water flow rate for a particular configuration of a water play structure (100) to match available water supply flow rate (e.g., from a residential garden hose), thereby resulting in an optimum performance of all play accessories simultaneously connected into a particular water play structure (100) configuration. Calculation of an optimum water flow rate to operate one or more water play accessories in a particular configuration of a water play structure (100), while matching an available water supply flow rate (e.g., from a residential garden hose), has been a difficult problem to solve, especially for a layperson such as a homeowner.

For storage or space savings, the water play structure (100) has a frame footprint that can be quickly and easily reduced, via folding arms and telescoping column, as will be discussed in more detail below.

Figure 1A:
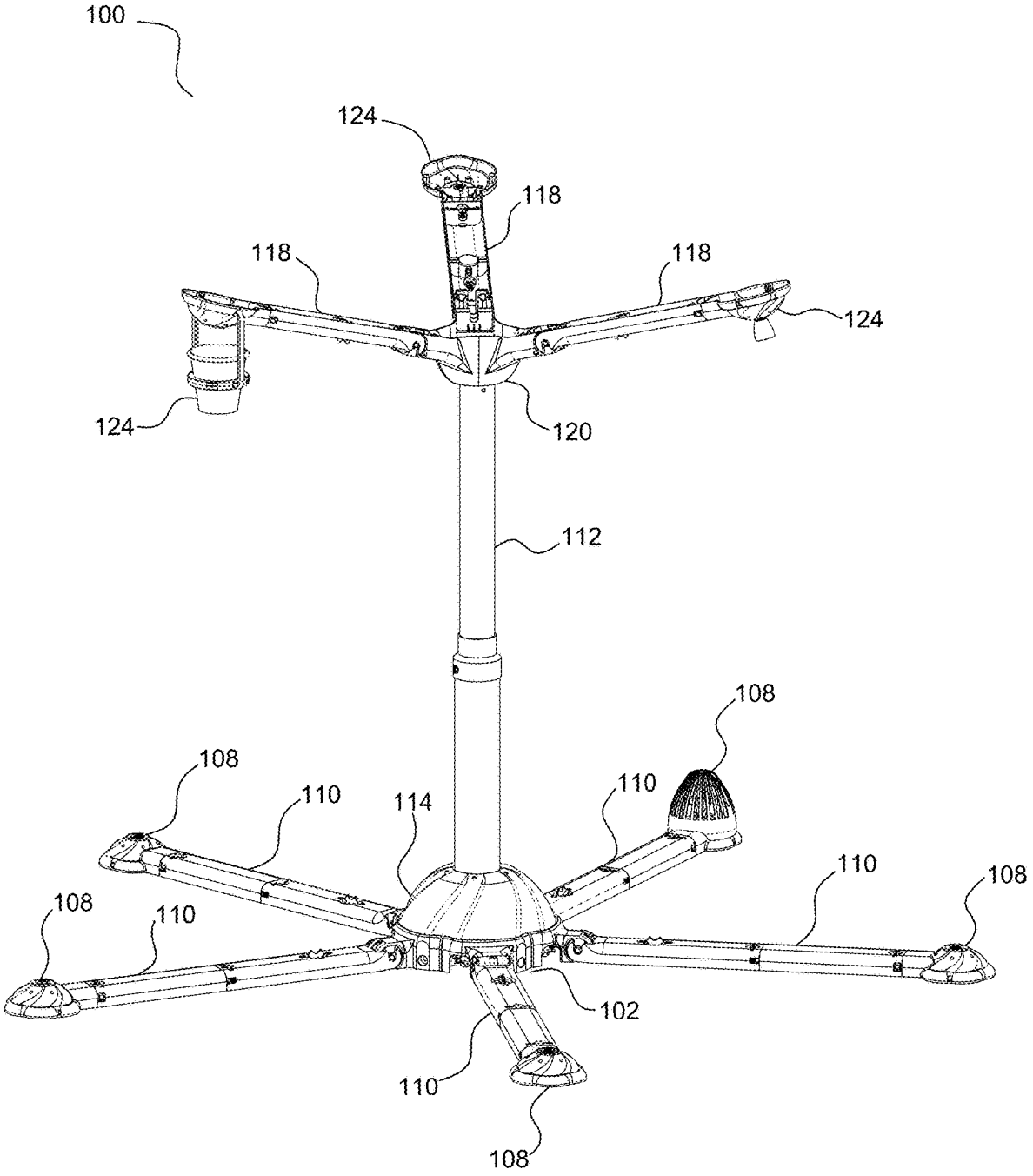
FIG. 1A is a perspective view of an example water amusement and play system, according to various embodiments of the present disclosure.
Figure 1B:
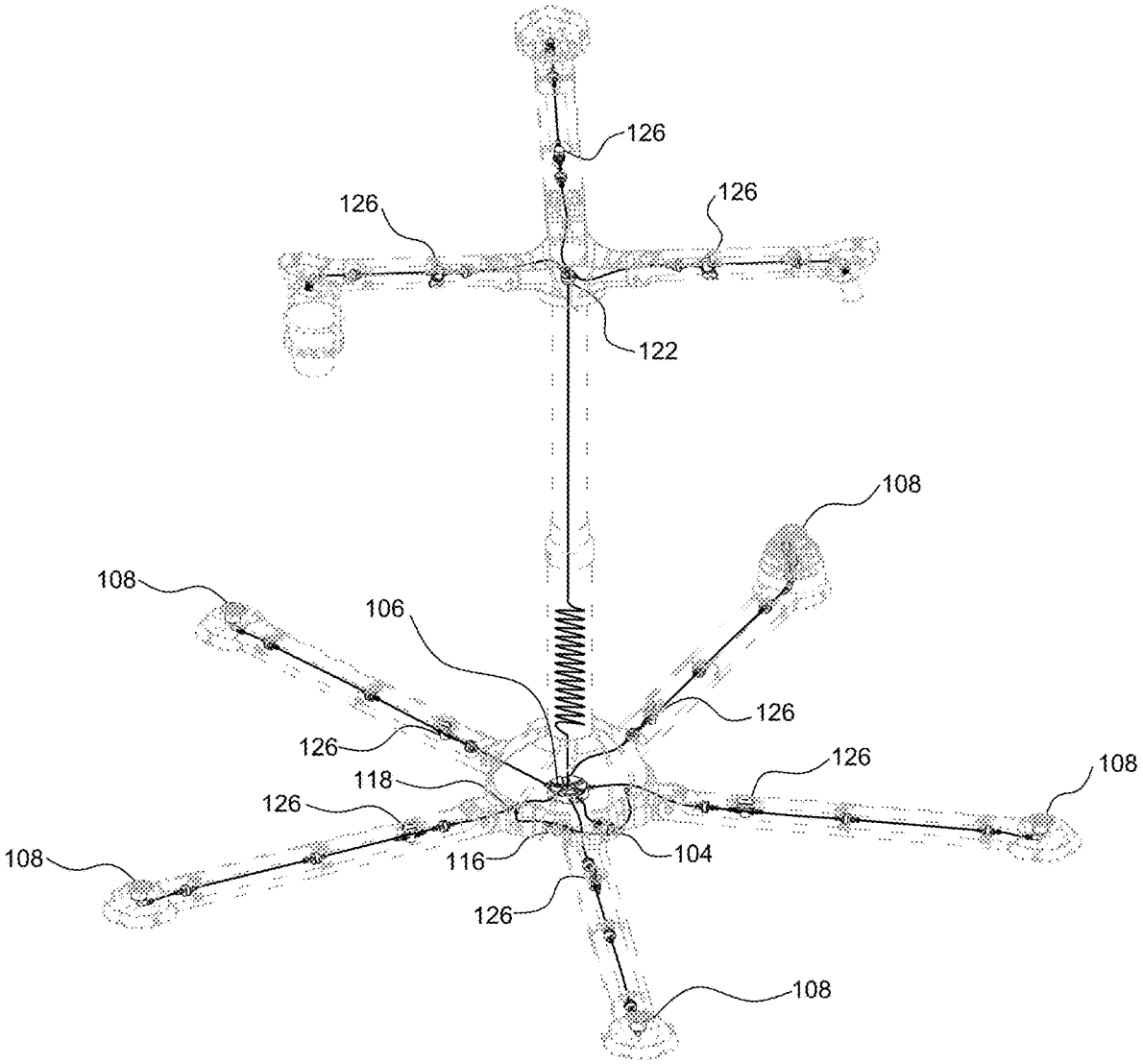
FIG. 1B is an X-ray view of the example water amusement and play system of FIG. 1A.

FIGS. 1A and 1B show an example of a water amusement system (100) according to various embodiments of the present invention. The water amusement system (100) includes a fixed-frame configuration, portable, exoskeletal water play structure with multiple stations designed for detachable play accessories that mechanically and hydraulically connect and securely lock to the frame in a leak-free manner using a single, ergonomic pushing action. The water supply line, which can be, but is not limited to a standard household garden hose, connects to the frame base (102) via standard ¾" garden hose thread (GHT) inlet fitting and connection (104). In this embodiment, a water reservoir (114) is mounted to, and supported by, the frame base (102). The water reservoir (114) has a first reservoir port coupled to the water inlet connection (104). The water reservoir (114) can hold a volume of water that is supplied by the water supply line through the water inlet connection (104) and through the first reservoir port. In the present example, the volume of water that is held in the water reservoir (114) is supplied by the water supply line, passes through the lower manifold (106), and thereby through the first reservoir port into the water reservoir (114). A lower manifold (106) is covered by, and mounted under and to the frame base (102) using snap fit. The lower manifold (106) distributes water supplied from the water inlet connection (104) to all the lower play stations (108) through the frame lower arms (110) and to the upper manifold (122), using flexible tubing and fittings inside the frame lower arms (110) and frame column (112). The frame base (102) also mechanically supports the frame lower arms (110) and water reservoir (114), allows routing of all tubing, and houses a flow valve (116) to fill the water reservoir (114), whose primary function is to stabilize the water play structure (100) utilizing the weight of the volume of water collected in the reservoir (114) during use and play. The reservoir (114), according to the example, is plumbed in parallel with one of the lower manifold (106) outlet lines via a splitter (118) and a flow valve (116), such that when the flow valve (116) is open, water flows into the reservoir (114) until such point that the reservoir (114) fills and the flow valve (116) is shut off by the user. This reservoir (114) plumbing configuration also enables the reservoir (114) to self-drain through the water supply inlet fitting (104) once the water supply line is disconnected and the flow valve (116) is opened, thereby eliminating the need for a user to manually fill and drain the reservoir (114). With a drained empty reservoir (114) the water play structure (100), which includes the frame base (102), is much lighter and readily portable by a user on their person. In various embodiments, the frame base (102), reservoir (114), and lower manifold (106) are all combined and integrated into a single part.

The frame lower arms (110) are mechanically attached to the frame base (102) in a manner that allows them to rotate and lock into position for use or storage. In a similar fashion, the frame upper arms (118) are attached to the frame upper hub (120), which houses an upper manifold (122) that distributes water to each of the upper play stations (124) through tubing and fittings mounted inside the frame upper arms (118). According to various embodiments, each of the frame lower arms (110) and each of the frame upper arms (118) can be equipped with a flow valve (126) that allows a user to control the amount of water delivered to the respective play station (108, 124), connected to the particular arm (110, 118), and thereby limit the intensity of the water effects or the number of play stations being used. Alternatively, or in addition to, flow valves can be located at each extremity of the base frame (102) and top hub (120).

Figure 2A:
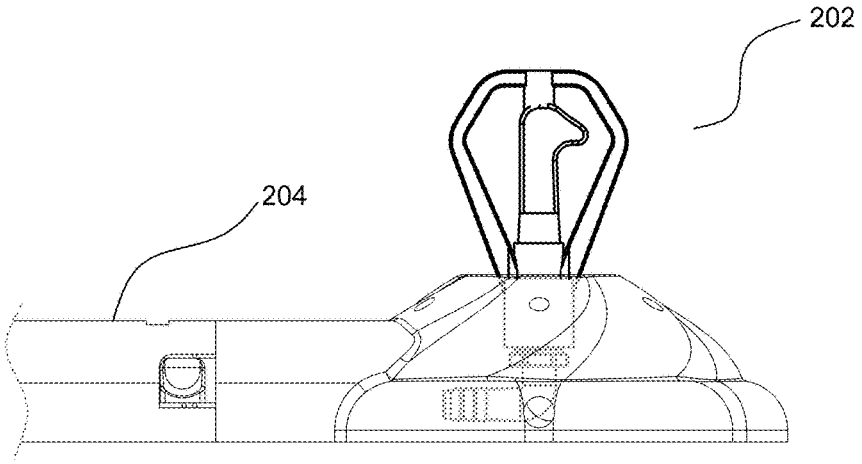
FIG. 2A is a side view of an example accessory station to frame arm coupling assembly, such as for use by the water amusement and play system of FIG. 1A.
Figure 2B:
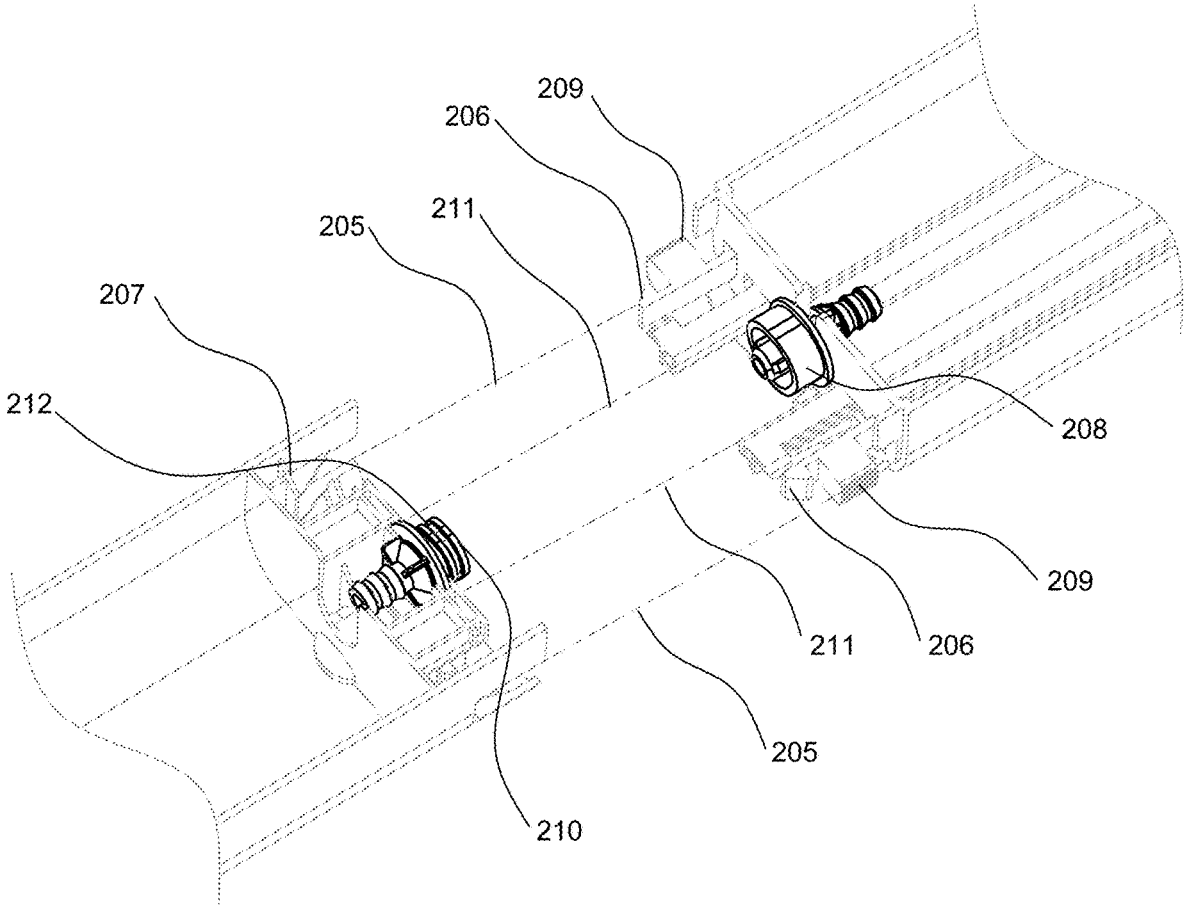
FIG. 2B is a bottom perspective view of an example accessory station disconnected from the frame arm of FIG. 2A.
Figure 3A:
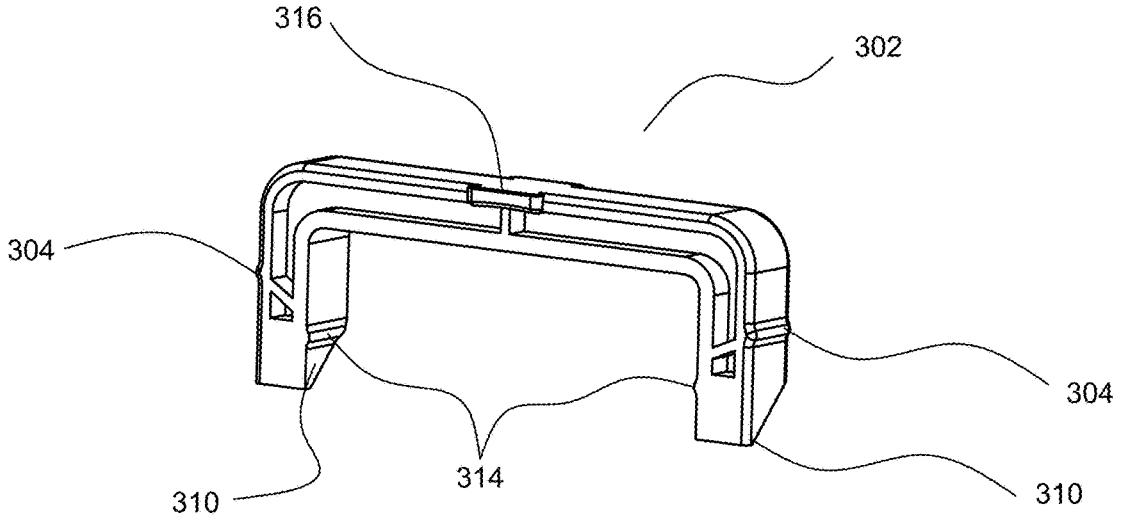
FIG. 3A is a perspective view of an example accessory connection retention bracket, according to various embodiments of the present disclosure.
Figure 3B:
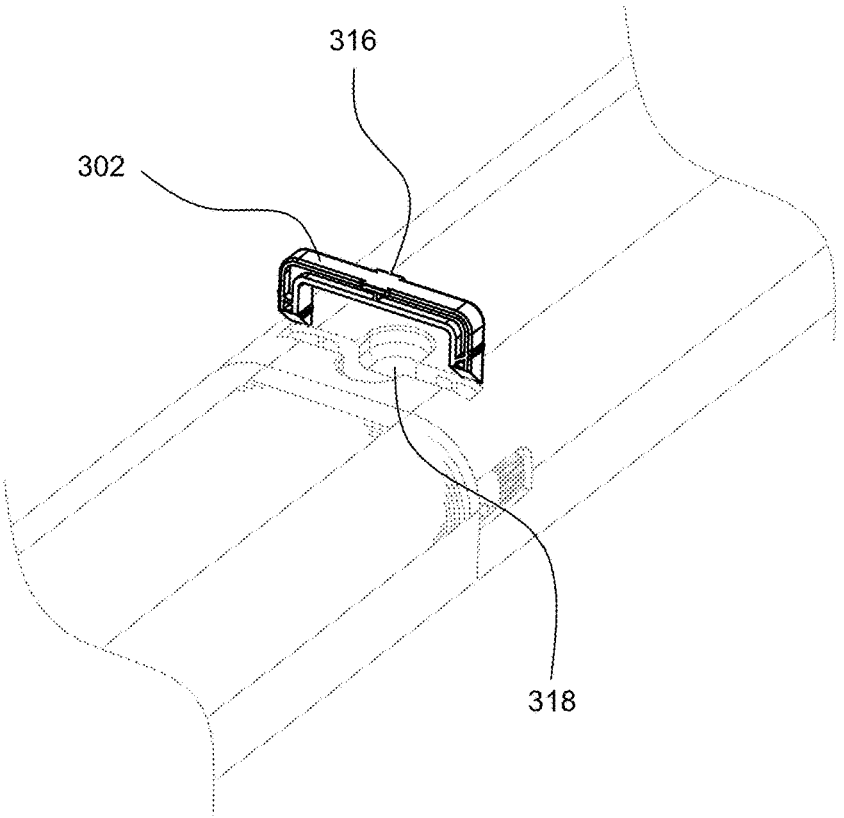
FIG. 3B is a perspective view of the example accessory connection retention bracket being mounted into a frame arm, according to various embodiments of the present disclosure.
Figure 3C:
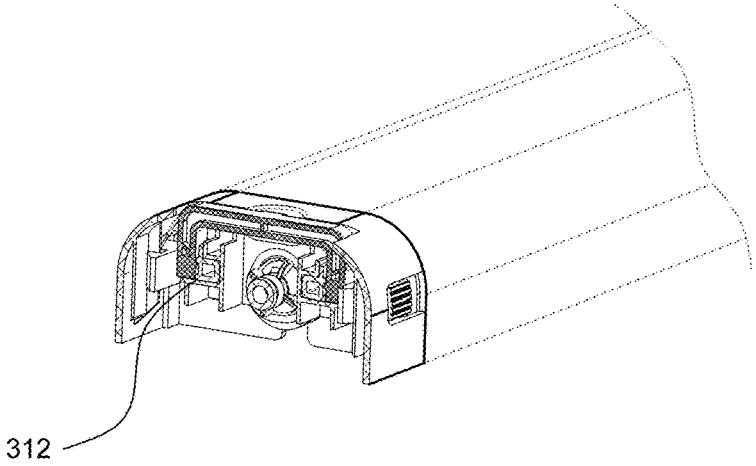
FIG. 3C is a perspective view of the example accessory connection interface with the retention bracket in locked position.
Figure 3D:
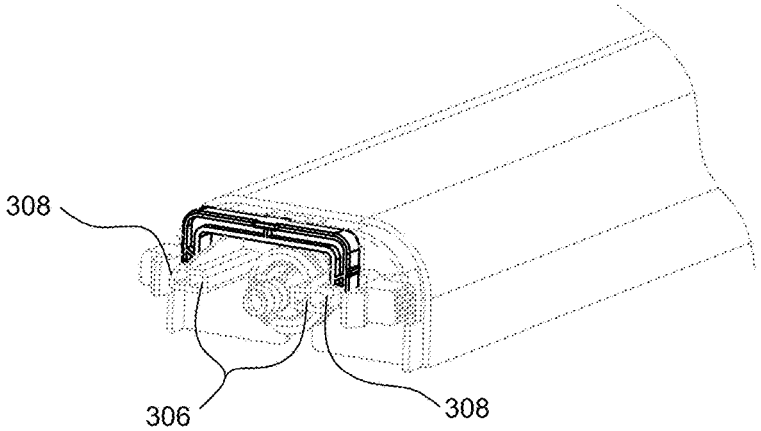
FIG. 3D is a perspective view of the example accessory connection retention bracket moving into a locking position, according to various embodiments of the present disclosure.
Figure 3F:
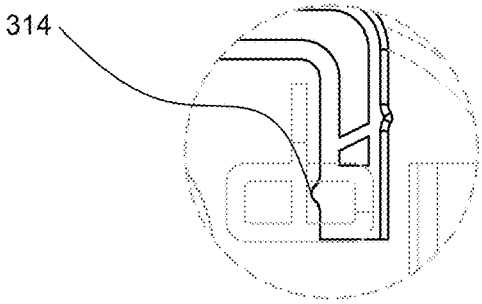
FIG. 3F is a zoomed in view of the bracket interference fit of FIG. 3E.
Figure 3E:
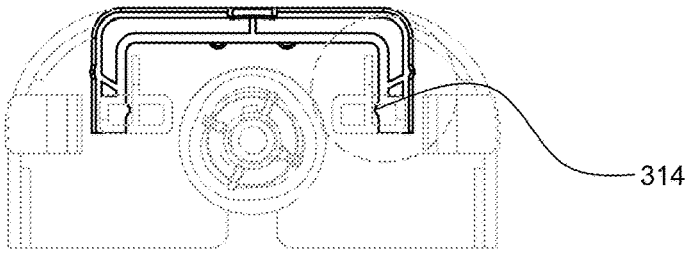
FIG. 3E is a perspective view of an example accessory connection interface with a retention bracket interference fit with the accessory, according to various embodiments of the present disclosure.

Referring to FIGS. 2A-2B, an example play accessory (202) can be assembled and secured to a frame arm (204), in a single step. The frame arm (204), according to the example, extends horizontally radially outward from, and mounted to, one of the frame base or the telescoping hollow frame column (112). A self-locking and secure mechanical connection between the play accessory (202) and the frame arm (204) can be accomplished using snap fit retention features on an interface structure of the frame arm (204) and on an interface structure of the play accessory (202), as will be discussed below. The interface structure of the frame arm (204) and the interface structure of the play accessory (202), according to various embodiments, are standardized mutually compatible interface structures which allow different play accessories (202) to be coupled to, and used with, the various frame arms (204) in a modular system (100) implementation.

According to the present example, the interface structure of the play accessory (202) includes snap fit tabs (206). The interface structure of the frame arm (204) includes snap fit retention features (207) that are compatible with receiving and locking in place the snap fit tabs (206) when pushed in a linear movement (205) to mate and couple the interface structure of the play accessory (202) with the interface structure of the frame arm (204). Water flow from tubing in the frame arm (204) can flow into tubing in the play accessory (202) to allow the mated and coupled play accessory (202) to operate with water flowing from the frame arm (204). Finger access to a push button (209) connected to the snap fit tab (206) allows users to easily unlock and disconnect the play accessory (202) from the frame arm (204) with a single, ergonomic squeezing of the push button (209) combined with a pulling motion (211). A hydraulic seal can be achieved using male (210) and female (208) slip fit fittings with O-rings (212) pre-assembled to the male fitting (210), whereby the male fitting (210) may be pre-assembled to the frame arm (204) interface structure, and the female fitting (208) may be pre-assembled to the play accessory (202) interface structure, or vice versa. Various embodiments of a single, push-to-lock interface structure could be used. For example, and not for limitation, interface structures for the frame arm (204) and the play accessory (202) could include a spring loaded ball & detent mechanism.

Referring to FIGS. 3A-3F, an optional secondary retention bracket (302) keeps the play accessory (202) interface structure secured to the frame arm (204) interface structure and prevents disconnection of the interface structures from each other in the event that the snap fit tabs (206) and snap fit retention features (207) fail to secure the interconnection of the play accessory (202) to the frame arm (204).

The retention bracket (302), according to various embodiments, may be pre-assembled to the frame arm (204) and free floating with a retention detent (304) to prevent it from falling out. According to the present example, as the play accessory (202) is pushed into locking position on the frame arm (204), support beams (306) with chamfered edges (308) on the accessory (202) interface lift up the retention bracket (302), also having matching chamfered edges (310). Once the play accessory (202) locks into final position on the frame arm (204), and the retention bracket (302) vertically aligns with a receiving cutout (312) on the accessory support beam (306), the retention bracket (302) then partially seats back down. The retention bracket (302) locks into final position when pushed down such that a locking detent (314) on the retention bracket (302) creates an interference fit against the edges of the support beam (306) on the accessory (202) interface. By positioning and sizing of the supporting beams (306) and snap fit tabs (206) so that they are properly aligned and in close proximity to each other, the retention bracket (302) also functions as a lock out feature, preventing unintentional disengagement of the accessory snap fit tabs (206), thereby keeping the accessory (202) securely locked in place. To remove an accessory (202), the retention bracket (302) must first be pulled out using the finger grip feature (316) exposed by the cutout (318) on the frame arm (204) before detaching the accessory (202) with a single, ergonomic squeezing and pulling motion.

Figure 4:
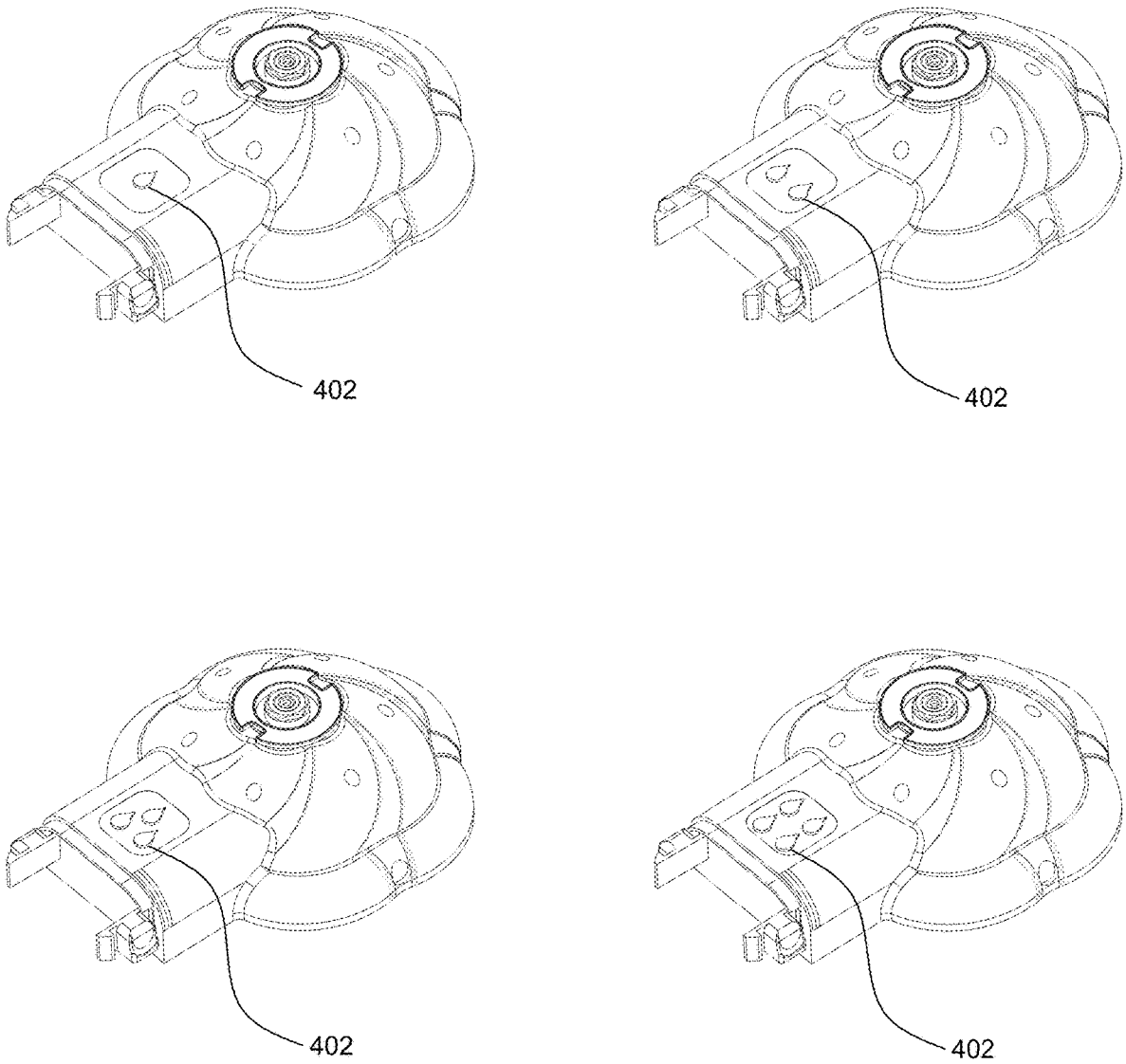
FIG. 4 is a perspective view of several example accessory stations marked with symbolic flow capacity designations, according to various embodiments of the present disclosure.
Figure 5A:
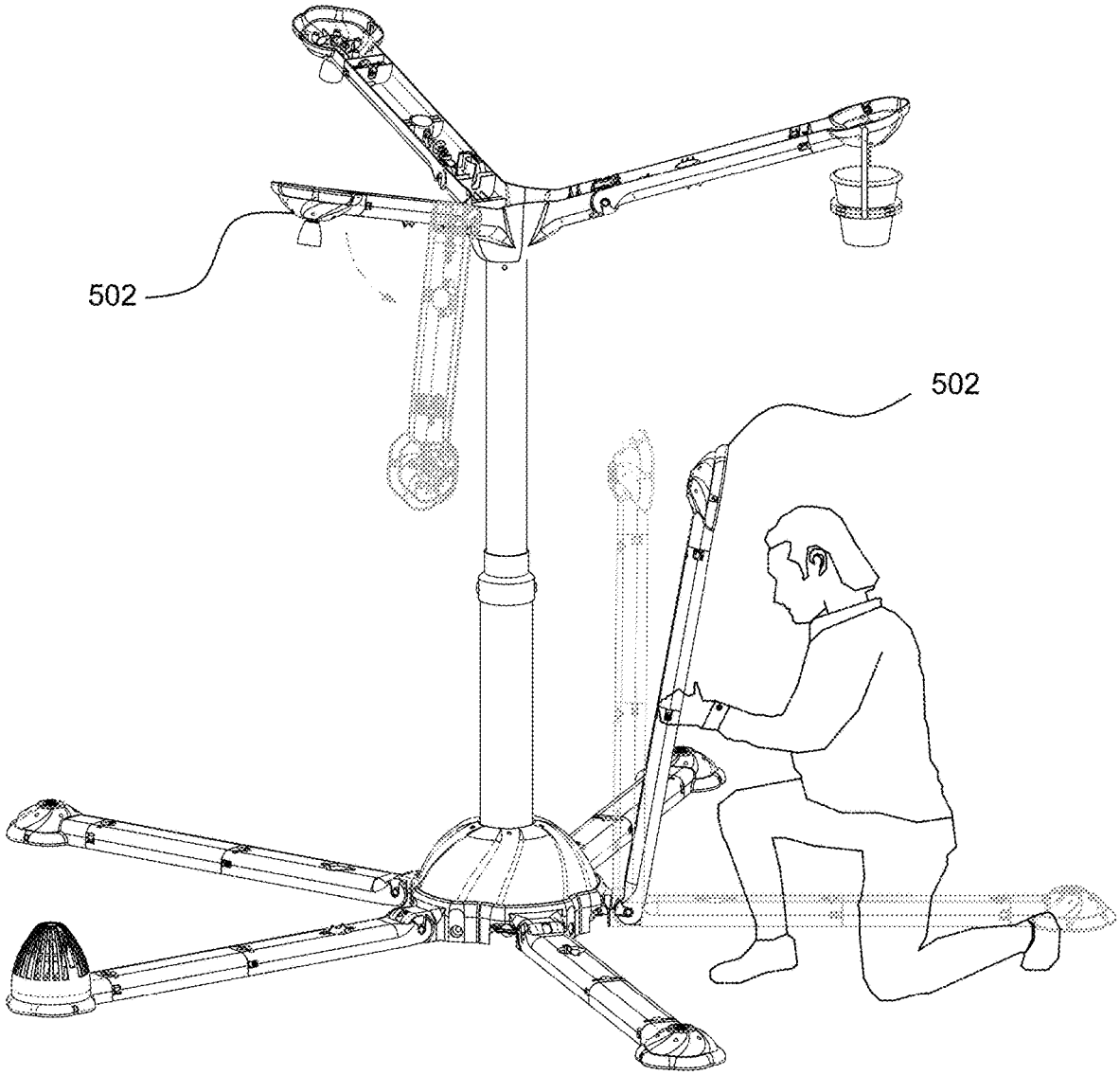
FIG. 5A is a perspective view of an example folding frame arm, such as for use by the water amusement and play system of FIG. 1A, according to various embodiments of the present disclosure.
Figure 5B:
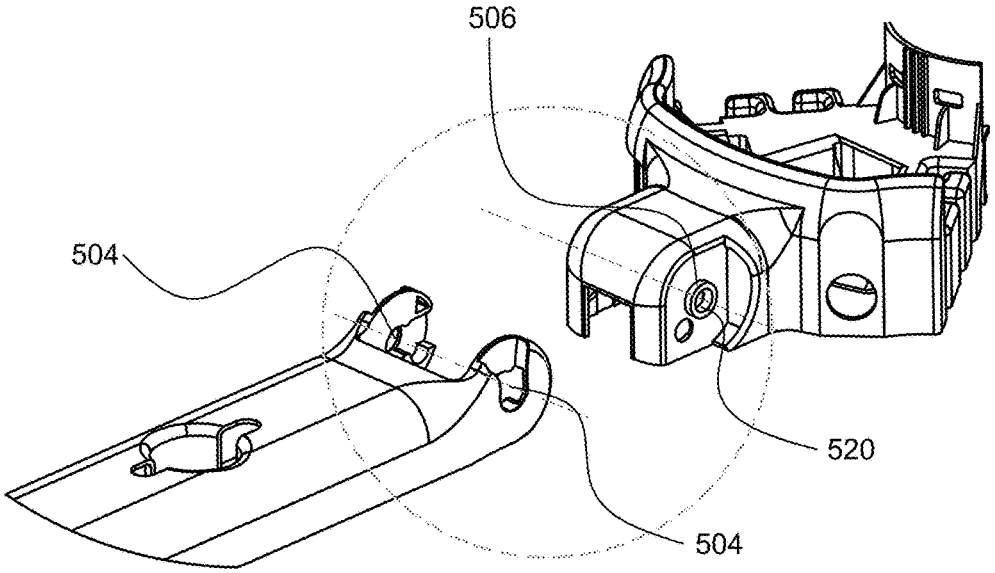
FIG. 5B is a perspective view of the frame arm hinge mechanism, such as for use with the folding frame arm of FIG. 5A.
Figure 5C:
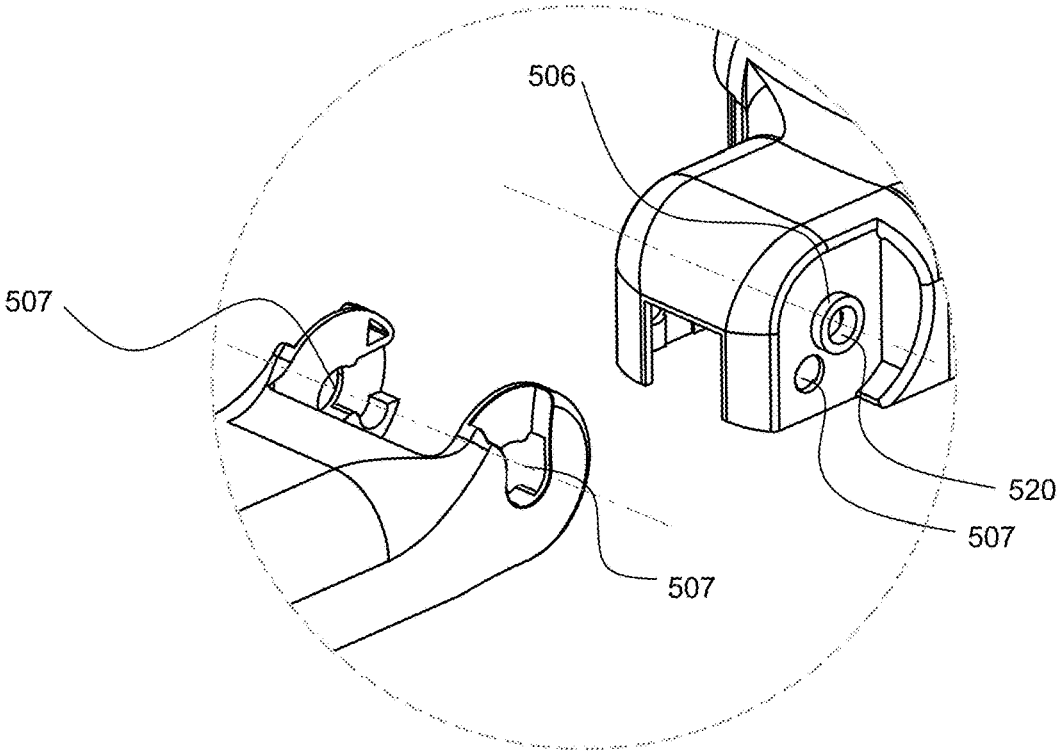
FIG. 5C is a zoomed in view of the frame arm hinge mechanism of FIG. 5B.
Figure 5D:
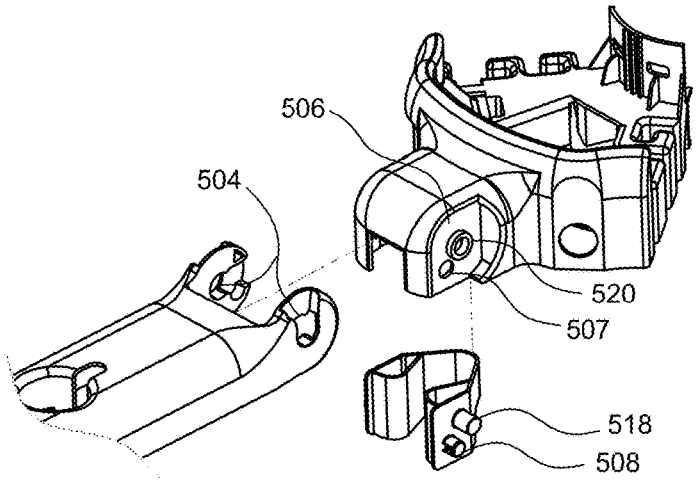
FIG. 5D is a perspective view of the hinge locking mechanism, such as for use with folding frame arm of FIG. 5A.
Figure 5E:
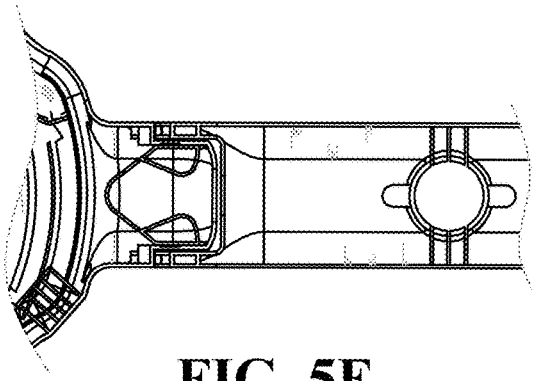
FIG. 5E is a bottom view of an example hinge assembly, such as for use with the folding frame arm of FIG. 5A.
Figure 5F:
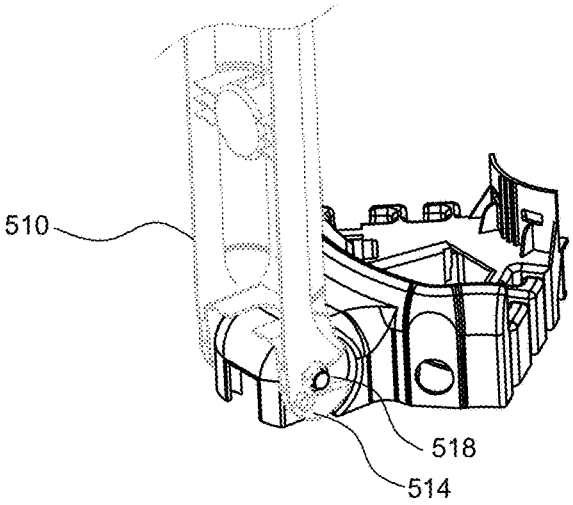
FIG. 5F is a perspective view of the hinge assembly of FIG. 5D in a first position which is folded.
Figure 5G:
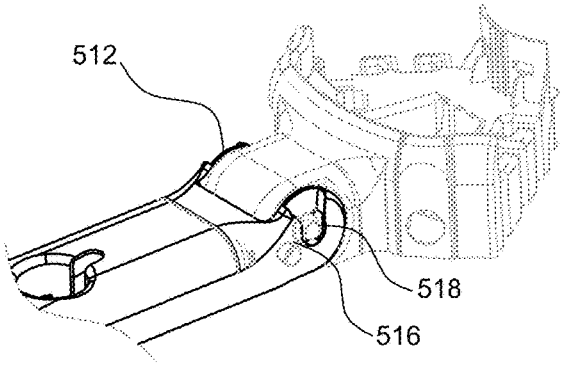
FIG. 5G is a perspective view of the hinge assembly of FIG. 5D in a second position, which is extended out.
Figure 6A:
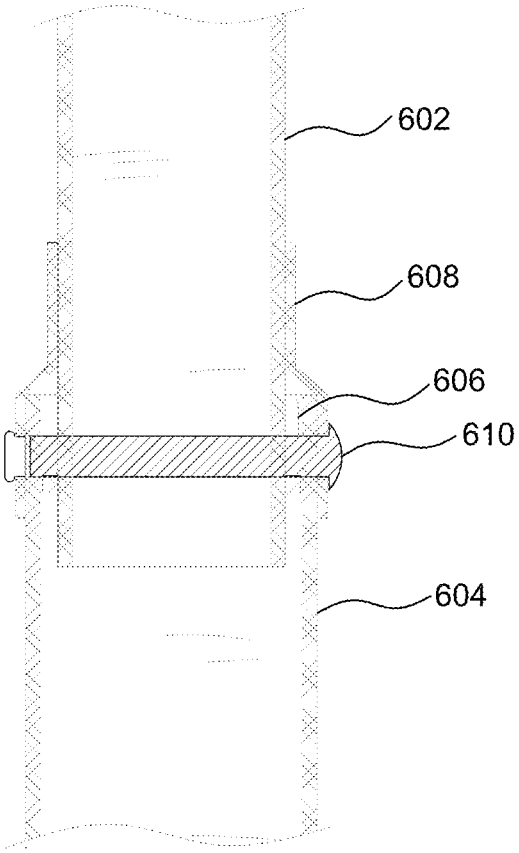
FIG. 6A is a cut-away view of an example telescoping frame column, according to the present disclosure.
Figure 6B:
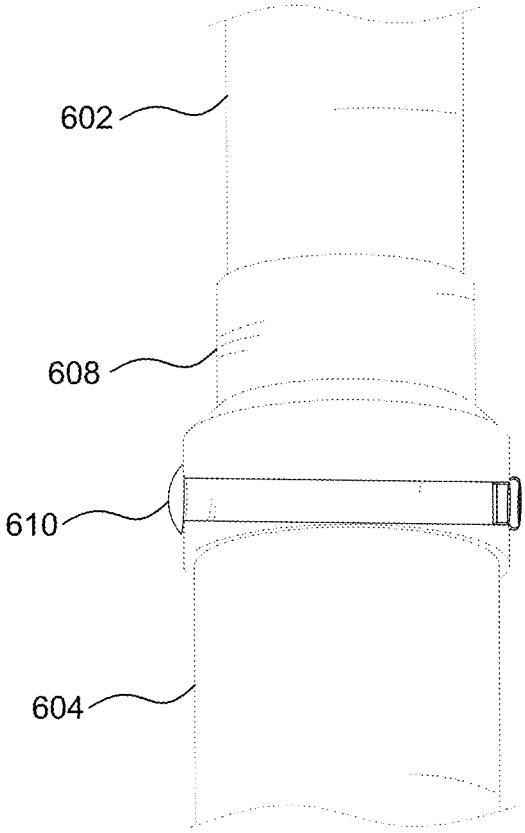
FIG. 6B is an X-ray view of the telescoping frame column of FIG. 6A, showing an example locking mechanism for the telescoping frame column, according to the present disclosure.
Figure 6C:
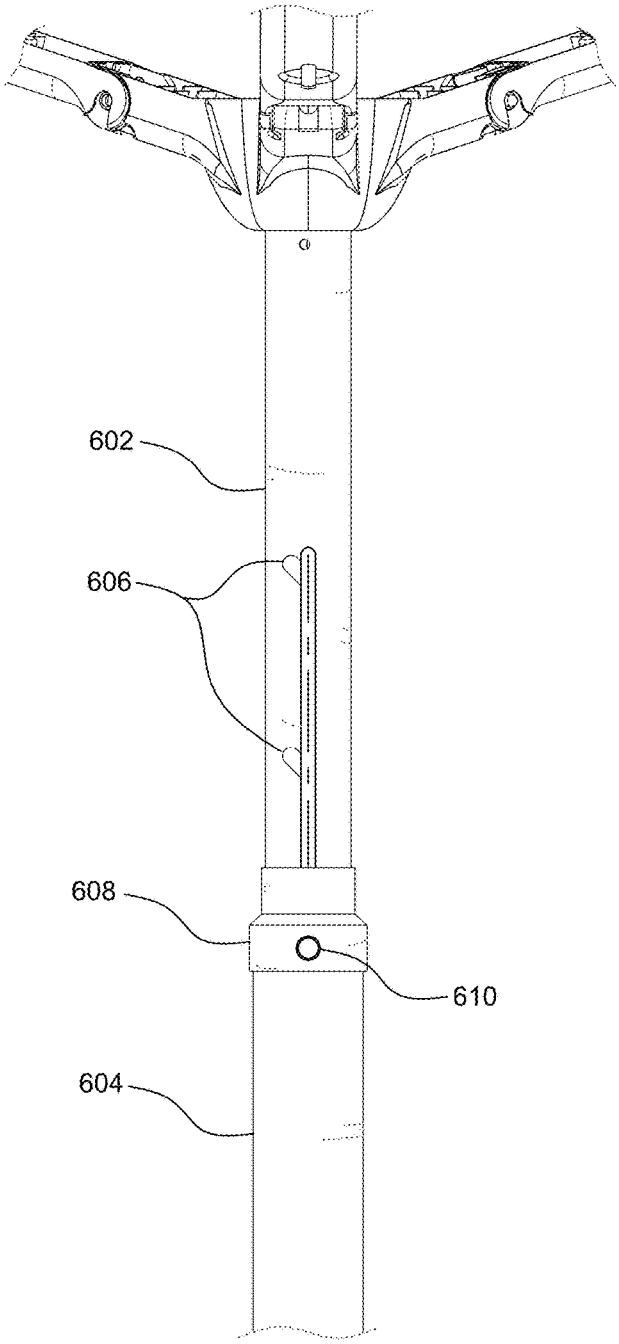
FIG. 6C is a perspective view of the telescoping frame column of FIG. 6A, according to the present disclosure.
Figure 6D:
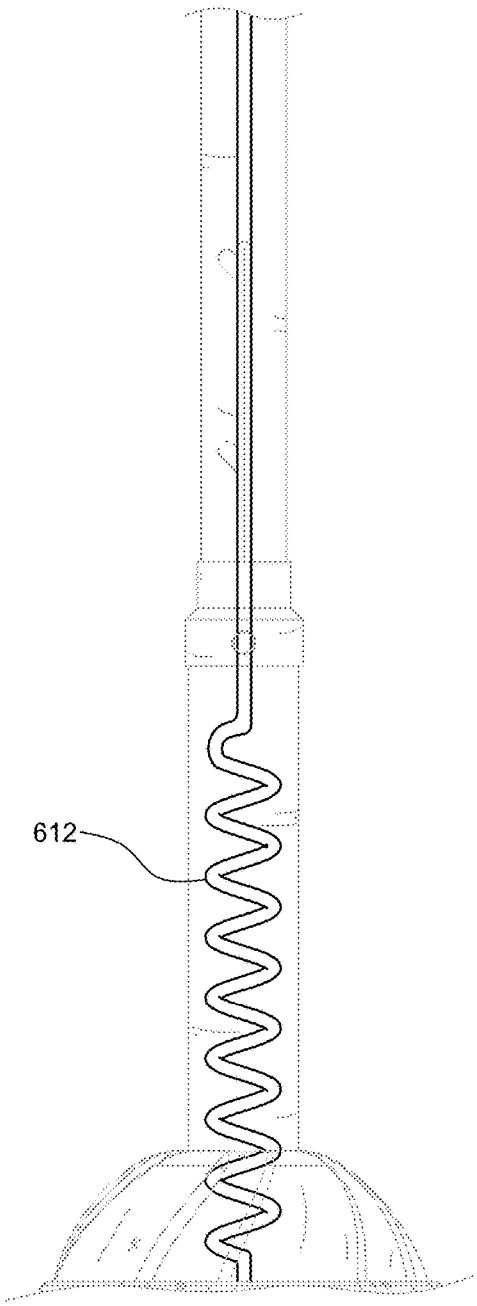
FIG. 6D is an X-ray view of the telescoping frame column of FIG. 6C, showing an example plumbing configuration to support telescoping function.

As depicted in FIG. 4, according to various embodiments, play accessories (202) can utilize an indicator artifact, affixed to, stamped on, or otherwise integrated with, each play station (202). Each indicator artifact on a play accessory (202) can be, for example, a symbolically coded indicator artifact (402) in a readily visible location on the play accessory (202) for easy identification of their water flow consumption rates using a simple point-based system. This enables an easier and more intuitive set up and configuration of the particular water play structure (100) that aligns with available flow capacity at the use location and ensures simultaneous, optimum performance of all connected accessories (202). Available flow capacity (i.e., total number of points the system could effectively run simultaneously) at the use location would be determined by measuring the time to fill a container of specific volume (e.g., 1 gallon jug) and using a cross reference table based on flow rate such as (Table 1) below.

TABLE 1

Flow and Point Capacity Reference Table

| Time to Fill 1 Gallon Container (sec) | Available Flow Rate (gpm) | Total Points That Can Simultaneously Be Run Optimally |
|---|---|---|
| 6 | 10 | 20 |
| 8 | 7.5 | 15 |
| 12 | 5 | 10 |

Table 2 outlines one example of point and symbolic designations coded in an indicator artifact (402) for each of the play accessory flow ranges.

TABLE 2

Accessory Flow Ranges and Designations

| Accessory Flow Range | Point Designation | Symbolic Designation |
|---|---|---|
| 0.25-0.75 gpm @ TBD psig | 1 | ♁ |
| 0.76-1.25 gpm @ TBD psig | 2 | ♁♁ |
| 1.26-1.75 gpm @ TBD psig | 3 | ♁♁♁ |
| 1.76-2.25 gpm @ TBD psig | 4 | ♁♁♁♁ |

Referring to FIGS. 5A-5G, for storage and transportation, the horizontal footprint of the frame can be quickly and easily reduced without having any loose, disconnected parts through the folding functionality (502) of the frame arms (204). Both the lower frame arms (110) and upper frame arms (118) fold up and down, respectively, and lock in place. The folding end of the frame arms (204) have pivot holes (504) which allow rotation of the frame arm (204) around pivot bosses (506) that protrude from the sides of the frame base (102). A set of holes (507) on the side of the frame base (102), according to the present example, allow a locking pin (508) located inside the frame base (102) to protrude and lock the frame arms (204) into one of many possible positions, this embodiment only depicting two positions, which are folded approximately 90 degrees (510) and extended straight out (512). This is accomplished by positioning an additional two sets of holes on the folding end of the frame arms (204), one set of holes (514) to receive the locking pin (508) in the folded position (510) and the other set of holes (516) to receive the locking pin (508) in the extended position (512). When pushed, a release pin (518) retracts the locking pin (508) and allows the frame arm (204) to move. This release pin (518) is connected to the locking pin (508) and is located concentric to the pivot bosses (506), such that there is a through hole (520) in that location of the frame base (102), which allows the release pin (518) to protrude for easy access by the user. The locking pin (508) and release pin (518) in this example are integrated into a single piece plastic part which relies on the material properties and geometry of said part design to accomplish the desired travel distance and force required for the mechanism to function properly and be easy to operate by the user. Alternatively, as another example, the locking pin (508) and release pin (518) could be a spring ball-detent mechanism.

The vertical footprint of the frame structure (100) can also be quickly and easily reduced to further enhance storage or transportation process through a telescoping hollow frame column (112) that is supported in a vertical orientation by the frame base (102). According to the present example, the telescoping hollow frame column can be telescoped in incremental steps where each step can be set and locked-in to provide another vertical height for the telescoping hollow frame column (112), as will be further discussed below.

In this example, the telescoping is achieved with a smaller standard diameter (3") PVC pipe as an upper column segment (602) nested inside a larger standard diameter (4") standard PVC pipe as a lower column segment (604), with a spacer (606) attached to the lower end of the upper column segment (602) and a collar (608) attached to an upper end of the lower column segment (604) to achieve a tight, slip fit relative motion. In this example, the upper column segment (602) can be set and locked into one or more extended positions (e.g., resulting in one or more vertical heights for the telescoping hollow frame column) by adjusting and rotating the upper column segment (602) relative to the lower column segment (604) so that the angled plurality of slots (606) on the upper column segment (602) slides over the fixed retaining pin (610). To change column height positions, the upper column segment (602) would be lifted and rotated out of the locked position in one of the slots and moved to another step change in column height at another one of the slots. The upper column segment (602) would then be rotated into the locked position with the retaining pin (610) in the another one of the slots. Another example structural arrangement could use through holes on the upper column (602) with a removable or retractable retaining pin. Tubing for transmission of water connects from a barbed port on the lower manifold (106) in the frame base (102) to a barbed port on the upper manifold (112) in the frame upper hub (120). The tubing is routed inside the upper and lower columns, with enough slack to allow for full extension of the column, where in one embodiment, the tubing is in a coiled configuration (612) that allows free movement of upper column without interference or kinking.

The illustrations of examples described herein are intended to provide a general understanding of the structure of various embodiments, and they are not intended to serve as a complete description of all the elements and features of apparatus and device that might make use of the structures described herein. Many other embodiments will be apparent to those of ordinary skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense. The terms "a" or "an", as used herein, are defined as one or more than one. The term "plurality", as used herein, is defined as two or more than two. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes structure that is adapted to, set up, arranged, commanded, altered, modified, built, composed, constructed, designed, or that has any combination of these characteristics to carry out a given function. The term "adapted to" describes structure that is capable of, able to accommodate, to make, or that is suitable to carry out a given function.

The Abstract is provided with the understanding that it is not intended be used to interpret or limit the scope or meaning of the claims. In addition, in the foregoing Detailed Description, various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The corresponding structures, materials, acts, and equivalents of all means or step plus function elements, if any, in the claims below are intended to include any structure, material, or act for performing the function in combination with other claimed elements as specifically claimed. The description herein has been presented for purposes of illustration and description, but is not intended to be exhaustive or limited to the examples in the form disclosed. Many modifications and variations will be apparent to those of ordinary skill in the art without departing from the scope of the examples presented or claimed. The disclosed embodiments were chosen and described in order to explain the principles of the embodiments and the practical application, and to enable others of ordinary skill in the art to understand the various embodiments with various modifications as are suited to the particular use contemplated. It is intended that the appended claims below cover any and all such applications, modifications, and variations within the scope of the embodiments. Although specific embodiments of the subject matter have been disclosed, those having ordinary skill in the art will understand that changes can be made to the specific embodiments without departing from the scope of the disclosed subject matter. The scope of the disclosure is not to be restricted, therefore, to the specific embodiments, and it is intended that the appended claims cover any and all such applications, modifications, and embodiments within the scope of the present disclosure.

The invention claimed is:

1. A water play structure, the water play structure comprising:

a frame base including:

a water inlet connection for connection to a water supply line;

a water reservoir, covered by and mounted to the frame base, for holding a volume of water in the water reservoir and having a first reservoir port selectively coupled by a user controllable flow valve to the water inlet connection to selectively receive, with the user controllable flow valve open, water flow from the water supply line and through the water inlet connection to fill the water reservoir, and then with the user controllable flow valve closed holding the volume of water in the water reservoir, or selectively drain, with the water inlet connection disconnected from the water supply line and the user controllable flow valve open, water flow out from the water reservoir through the water inlet connection;

a lower manifold, in the frame base, having a plurality of lower manifold ports including:

a first lower manifold port coupled to the water inlet connection to receive water that flows from the water supply line and through the water inlet connection into the lower manifold; and at least a second lower manifold port and a third lower manifold port, the second lower manifold port coupled to at least one water play station to supply water that flows out of the lower manifold through the second lower manifold port to the at least one water play station; and a telescoping hollow frame column supported in a vertical orientation and stabilized by the frame base, the telescoping hollow frame column including a water line having a first end coupled to the third lower manifold port and having a second end coupled through the telescoping hollow frame column to a second water play station mounted on a rigid portion of the water play structure that is supported by the telescoping hollow frame column, to distribute water flowing from the second lower manifold port, through the telescoping hollow frame column, to the second water play station.

2. The water play structure of claim 1, wherein the water play structure, including the frame base with an empty water reservoir, and including the telescoping hollow frame column telescoped to a minimum height, is readily portable by a user on the user's person.

3. The water play structure of claim 1, wherein telescoping hollow frame column includes a plurality of slot openings in one segment of the telescoping hollow frame column and a retaining pin fixed to another segment of the telescoping hollow frame column, such that an upper segment of the column can be telescoped relative to a lower segment of the column in incremental steps at each of the slot openings, where each step can be set and locked-in to provide another vertical height for the telescoping hollow frame column.

4. The water play structure of claim 1, further comprising:

at least one upper frame arm extending horizontally outward from, and mounted to, the telescoping hollow frame column, the water line having the second end coupled through the inside of the telescoping hollow frame column, and through the inside of the upper frame arm, and coupled to the second water play station to provide water flow to the second water play station through the water line, the second water play station being mounted on an outward distal end of the upper frame arm.

5. The water play structure of claim 1, further comprising:

at least one upper frame arm extending horizontally outward from, and mounted to, the telescoping hollow frame column, an outward distal end of the upper frame arm including a first interface structure, and the second water play station including a second interface structure, wherein the first interface structure and the second interface structure are standardized mutually compatible interface structures which allow different water play stations to be coupled to, and used with, the upper frame arm in a modular implementation.

6. The water play structure of claim 1, further comprising:

a plurality of frame arms, each frame arm extending horizontally radially outward from, and mounted to, one of the frame base or the telescoping hollow frame column, an outward distal end of each frame arm including a first interface structure, and each water play station, selected from a plurality of different water play stations, including a second interface structure, wherein the first interface structure and the second interface structure are standardized mutually compatible interface structures which allow different water play stations to be coupled to, and used with, each frame arm in a modular implementation.

7. A water play structure, the water play structure comprising:

a frame base including:

a water inlet connection for connection to a water supply line;

a lower manifold, in the frame base, having a plurality of lower manifold ports including:

a first lower manifold port coupled to the water inlet connection to receive water that flows from the water supply line and through the water inlet connection into the lower manifold; and at least a second lower manifold port and a third lower manifold port, the second lower manifold port coupled to at least a first water play station to supply water thereto from the second lower manifold port, and the third lower manifold port coupled to at least a second water play station to supply water thereto from the third lower manifold port; and a telescoping hollow frame column supported in a vertical orientation and stabilized by the frame base; and a plurality of frame arms, each frame arm extending horizontally radially outward from, and mounted to, one of the frame base or the telescoping hollow frame column, an outward distal end of a first frame arm including a first interface structure, and each water play station, selected from a plurality of different water play stations, including a second interface structure, wherein the first interface structure and the second interface structure are standardized mutually compatible interface structures which allow different water play stations to be coupled to, and used with, each frame arm in a modular implementation.

8. The water play structure of claim 7, wherein each water play station, selected from the plurality of different water play stations, includes an indicator artifact, affixed to, stamped on, or otherwise integrated with, the each particular water play station, indicator artifact indicating a water flow usage rate designation for that particular water play station.

9. The water play structure of claim 8, wherein the indicator artifact comprises a symbolically coded, point based water flow usage rate designation for that particular water play station.

10. The water play structure of claim 9, wherein the symbolically coded, point based water flow usage rate designation, of the indicator artifact of each water play station provides a user intuitive visual and/or tactile determination of a water flow rate for a particular configuration of the water play structure including a plurality of water play stations.

11. The water play structure of claim 7, wherein the plurality of frame arms are foldable at a joint coupling each frame arm to the one of the frame base or the telescoping hollow frame column, such that a frame footprint of the water play structure can be quickly and easily reduced.

* * * * *